US006216706B1

(12) United States Patent
Kumar et al.

(10) Patent No.: US 6,216,706 B1
(45) Date of Patent: Apr. 17, 2001

(54) METHOD AND APPARATUS FOR PRODUCING RECONSTITUTED TOBACCO SHEETS

(75) Inventors: Ashok Kumar, Richmond; Joao Gomes, Midlothian, both of VA (US)

(73) Assignee: Philip Morris Incorporated, Richmond, VA (US)

( * ) Notice: Subject to any disclaimer, the term of this patent is extended or adjusted under 35 U.S.C. 154(b) by 0 days.

(21) Appl. No.: 09/320,470

(22) Filed: May 27, 1999

(51) Int. Cl.[7] ..... A24B 3/14; A24B 15/12; F26B 3/00

(52) U.S. Cl. ..... 131/372; 131/370; 34/487; 34/452

(58) Field of Search ..... 131/353, 357, 131/370, 372, 373, 374, 290; 34/487, 452

(56) References Cited

U.S. PATENT DOCUMENTS

| | | | |
|---|---|---|---|
| 1,567,023 | 12/1925 | Larsson . | |
| 3,145,716 | 8/1964 | Geitz et al. | 131/133 |
| 3,224,108 | 12/1965 | Flaming | 34/87 |
| 3,228,113 | 1/1966 | Fannon, Jr. | 34/7 |
| 3,295,222 | 1/1967 | Geitz | 34/201 |
| 3,827,639 | 8/1974 | Relue et al. | 239/552 |
| 4,306,358 | 12/1981 | King, Jr. | 34/23 |
| 4,341,228 | 7/1982 | Keritsis et al. | 131/354 |
| 4,421,126 | 12/1983 | Gellatly | 131/371 |
| 5,099,864 | 3/1992 | Young et al. | 131/372 |
| 5,203,354 | 4/1993 | Hickle | 131/296 |
| 5,584,306 | 12/1996 | Beauman et al. | 131/370 |
| 5,724,998 | 3/1998 | Gellatly et al. | 131/372 |
| 5,743,022 | 4/1998 | Taylor | 34/68 |
| 5,845,415 * | 12/1998 | Sundqvist | 34/452 |

* cited by examiner

*Primary Examiner*—Stanley S. Silverman
*Assistant Examiner*—Dionne A. Walls
(74) *Attorney, Agent, or Firm*—Burns, Doane, Swecker & Mathis, LLP

(57) ABSTRACT

An apparatus and method for drying reconstituted tobacco sheets includes positioning a steam box below an endless conveyor belt. A slurry is cast onto the conveyor belt and conveyed over a steam box before entry into a drying apparatus. The steam box functions to pre-treat the slurry so as to increase the rate by which the slurry may be dried. The steam box includes the use of a perforated plate which encloses an upper portion of the steam box and which functions to uniformly distribute steam to the underside of the conveyor belt.

21 Claims, 4 Drawing Sheets

METHOD AND APPARATUS FOR PRODUCING RECONSTITUTED TOBACCO SHEETS

FIELD OF THE INVENTION

The present invention relates to a method and apparatus for producing reconstituted tobacco sheets. More particularly, the present invention relates to a method and apparatus for producing reconstituted tobacco sheets in a relatively rapid and uniform manner.

BACKGROUND AND SUMMARY

In the manufacture of tobacco products, tobacco by-products such as tobacco stems, leaf scraps, and tobacco dust produced during the manufacturing process can be recycled to reclaim their useful tobacco content. In the past, such tobacco by-products have been formed into what is known in the industry as reconstituted tobacco sheets.

Commonly owned U.S. Pat. No. 5,203,354 discloses a process for manufacturing reconstituted tobacco sheet by casting a tobacco containing slurry containing 20% solids and 80% liquid onto a rotating cylindrical dryer which is heated by gas, electricity or steam and the dryer reduces the moisture content of the slurry to 12–40%. In order to avoid deterioration of flavor and other properties of the tobacco the dryer surface temperature is from 180 to 200° F. A process for making reconstituted tobacco sheet by casting or extruding a tobacco slurry at 80–200° F. onto a continuous stainless steel belt and drying the slurry at 200–700° F. is described in commonly owned U.S. Pat. No. 5,724,998. Commonly owned U.S. Pat. No. 5,584,306 discloses a process for making reconstituted tobacco sheet by reverse-roll coating a slurry at 120–160° F. onto a stainless steel belt traveling at a line speed of 20–400 feet/minute and drying the slurry in a primary dryer and secondary dryer after which the sheet is doctored from the belt. In the examples of the '306 patent the belt speed was 30 fpm, the dryer was a gas-fired, air impingement dryer, and the sheet emerging from the secondary dryer had a moisture content of approximately 15% and sheet weight of 11.6–14.6 g/ft$^2$.

U.S. Pat. No. 5,099,864 describes a process for making reconstituted tobacco sheet wherein a tobacco slurry at 140–180° F. and solids content of 14–20% is cast as a 15–40 mil thick sheet on a stainless steel belt moving at 1.5 m/min and dried to a moisture content of about 14% and weight of 75–150 g/m$^2$. U.S. Pat. Nos. 4,306,358 and 5,743,022 describe apparatus for the drying of a reconstituted tobacco slurry.

During the drying process, prior art processes have utilized air impingement dryers and other drying equipment to remove the excess moisture. In order to effect rapid removal of water from the slurry, gas-fired air impingement dryers have been placed both above and below the conveyor belt downstream of the casting device. In such gas-fired, air impingement dryers, the thin layer of slurry arrives in a relatively cool state due to heat transferred to the steel belt and during heating by the dryers, a skin or "film" can form on the surface of the slurry which lowers the rate at which moisture can be evaporated from the slurry.

In view of the state of the art of making reconstituted tobacco sheet, there is a need for a processing apparatus and method which overcomes the slow evaporation problem caused by prior art techniques for drying reconstituted tobacco slurries. It would be desirable if such apparatus could be incorporated in existing processing equipment.

SUMMARY OF THE INVENTION

The invention provides an apparatus for producing a reconstituted tobacco sheet from an aqueous slurry wherein the apparatus includes an endless conveyor belt, a source supplying slurry to the conveyor at a deposition point, a steam heating arrangement which preheats the slurry as it enters a drying apparatus which reduces the moisture content of the thus-produced sheet to a desired level. The sheet can be further dried in a secondary drying apparatus which reduces the moisture content to a lower level. The steam heating arrangement can comprise a steam box arranged such that a portion of the conveyor above an upstream portion of the steam box is exposed to the open air and a portion of the conveyor above a downstream portion of the steam box is located in an air lock of the heating arrangement.

The invention also provides a method for producing a reconstituted tobacco sheet from an aqueous slurry, the method including steps of depositing the slurry on a conveyor, heating a portion of the conveyor with a steam heating arrangement so that the slurry is preheated to a preheat temperature, and drying the sheet in a drying apparatus which reduces the moisture content of the sheet to a desired level. The conveyor can be a stainless steel belt and the steam heating arrangement preferably heats the belt such that moisture evaporates from the slurry from the inside to the outside thereof. Due to the steam heating arrangement the speed of the belt can be increased considerably compared to heating arrangements which omit the steam heating arrangement.

BRIEF DESCRIPTION OF THE DRAWINGS

The above and other objects and advantages of the invention will be apparent upon consideration of the following detailed description, taken in conjunction with the accompanying drawings, in which.

DETAILED DESCRIPTION OF THE INVENTION

The invention provides improvements in productivity in manufacture of reconstituted tobacco sheet. In general, reconstituted tobacco sheet has been manufactured by casting a tobacco slurry onto a stainless steel belt which carries the slurry through air impingement driers to reduce the water content of the slurry from about 80% when it is deposited on the belt to less than about 40% on exiting the driers. In accordance with the invention, the air impingement driers are preceded by a steam heating apparatus which effects preheating of the slurry in a manner which allows the desired moisture content of the reconstituted tobacco sheet to be achieved while increasing the speed of the belt. Thus, the process and apparatus according to the invention can provide substantial improvement in the rate of production of reconstituted tobacco sheet.

According to one embodiment of the invention, the steam heating apparatus comprises at least one steam box positioned beneath the belt at a location between a slurry caster and the entrance to an air drying arrangement. The slurry on at least an upstream portion of the belt above the steam box can be exposed to the open air. Heat generated by the steam box is effective to minimize temperature gradients in the slurry by either rapidly increasing the slurry temperature to a substantially uniform preheat temperature prior to entry into the air drying arrangement or by maintaining the slurry at substantially the slurry casting temperature until the slurry enters the air dryer. The air drying arrangement preferably includes a series of air drying zones at different temperatures which supply heat to the slurry and reduce the water content thereof. For example, in the case where the steam box is located between the slurry caster and the air dryer, the slurry deposited on the belt can be at a temperature of about 150 to 180° F. (e.g., about 170° F.) and have a water content of about 70 to 85% (e.g., about 78%), the slurry deposited on the belt can lose heat to the belt and rapidly cool to about 70 to 120° F. (e.g., 80 to 90° F.), the steam box can heat the slurry to a preheat temperature of about 170 to 190° F. (e.g., 180 to 185° F.), and the air drying arrangement can supply heat to the slurry to reduce the moisture content of the sheet to below about 40% (e.g., 30 to 40%) upon exit from the air drying zones. The air drying zones are preferably preceded by an air lock which prevents the hot gas in the air drying zones from escaping into the open atmosphere.

Figure 1:
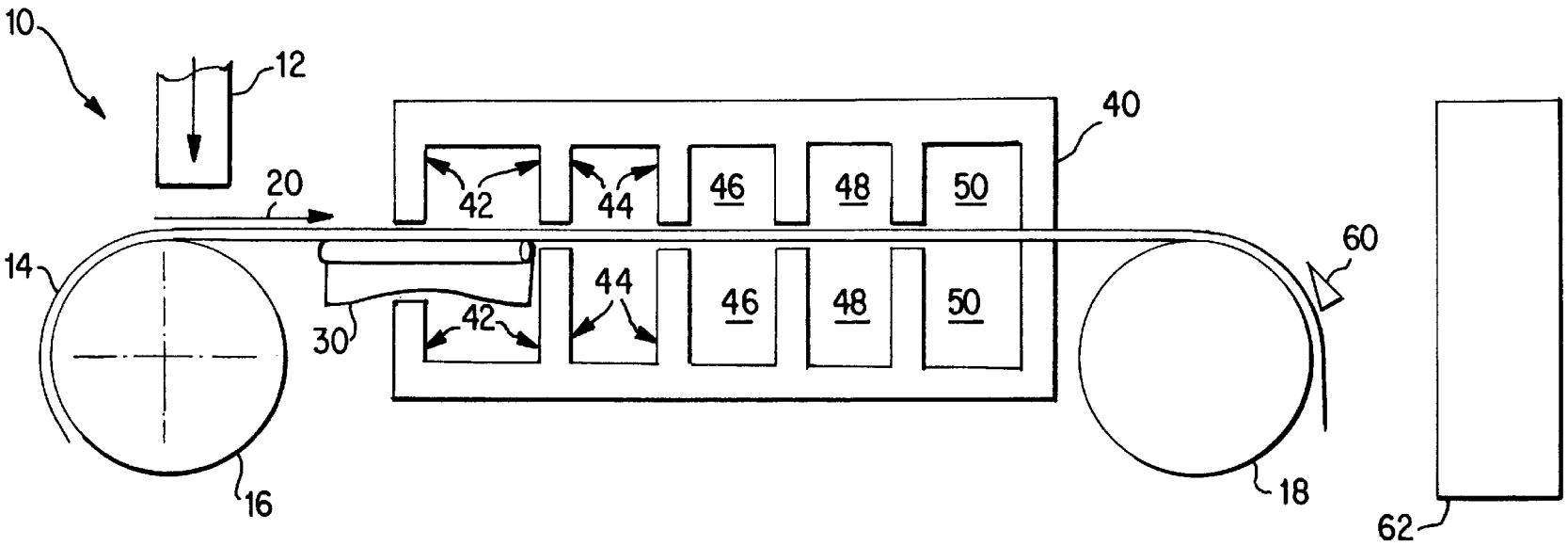
FIG. 1 is a schematic of an apparatus in accordance with the invention wherein a process line for drying a reconstituted tobacco slurry includes a steam box which preheats the slurry as it enters a gas-fired air dryer.

FIG. 1 shows an embodiment of the invention wherein an apparatus 10 for drying a reconstituted tobacco slurry includes a slurry casting device 12, a conveyor belt 14 supported by first and second rollers 16, 18, a steam box 30 and a drying apparatus 40. The slurry casting device 12 is located above the belt 14 at an upstream portion thereof and the belt 14 carries the slurry downstream in the direction of arrow 20. The casting device 12 may be any suitable device for depositing the slurry on the conveyor such as a casting box, reverse roll coater or other coating apparatus. The casting device preferably deposits a thin layer of a tobacco slurry comprising a mixture of tobacco scraps produced during a cigarette making process, one or more binding agents and water, e.g., a layer ranging in thickness from 0.01 to 0.2 inch thick, preferably 0.01 to 0.04 inch thick. Commonly owned U.S. Pat. Nos. 4,341,228; 4,421,126; 5,203,354; and 5,724,998, the disclosures of which are hereby incorporated by reference, describe various techniques for preparing reconstituted tobacco slurries which can be cast into the slurry. It will be apparent, however, that the drying apparatus according to the invention can be adapted for processing other types of slurries such as food products or powder compositions.

The conveyor belt 14 preferably defines a flat upper horizontal support and is driven in the direction of arrow 20 at a predetermined rate of speed, e.g., by rotation of one or both of the rollers 16, 18. The conveyor belt 14 can be made of any suitable material, e.g., stainless steel or other material suitable for withstanding the conditions in the drying apparatus. In the preferred embodiment, the belt is made of an impervious sheet of stainless steel.

The steam box 30 is arranged to heat the underside of the belt 14 such that the slurry on the portion of the belt passing over the steam box is rapidly heated. The steam box can be located between the casting device 12 and the drying apparatus 40 or combined with the drying apparatus 40. For instance, in the preferred embodiment, a downstream portion of the steam box is located in an upstream portion of the drying apparatus 40.

In the case where the slurry temperature drops due to heat loss to the conveyor belt, the steam box 30 can function to raise the temperature of the cast tobacco slurry to a preheat temperature before its entry into one or more heating zones of the drying apparatus 40. The steam can provide intense heating to the underside of the belt with the result that moisture can be driven from the inside to the outside of the slurry. In contrast, air drying arrangements remove moisture from the outside to the inside of the slurry with the result that a dried surface skin ("film") is formed which inhibits evaporation of moisture from inside the slurry. Accordingly, by passing the belt over the steam box prior to drying the slurry in the drying apparatus 40, it is possible to effect more rapid removal of moisture from the slurry in the drying apparatus than in the case where the drying apparatus is used without the steam box. For example, if the slurry can be dried to a desired moisture content by passing the belt through the drying apparatus at a speed such as 35 feet/minute, by incorporating the steam box in accordance with the invention prior to the drying apparatus, it is possible to increase the speed of the belt by at least 10% (e.g., 40 feet/min), preferably at least 25% (e.g. 45 feet/min), and more preferably at least 40% (e.g., 50 feet/min).

The drying apparatus 40 can be any suitable drying device. A preferred drying apparatus is a gas fired drier wherein gas such as natural gas is burned lean and a fan blows the combusted fuel/air mixture into a heating zone. According to a preferred drying technique, the belt passes through a plurality of heating zones which dry the slurry to a moisture content suitable for removing a partially dried sheet of the reconstituted tobacco from the end of the belt by a doctor blade. In the embodiment shown in FIG. 1, the drier includes an air lock portion 42, and four heating zones, 44, 46, 48, and 50.

The air lock portion 42 forms an entrance to the drier and prevents hot air from escaping from the heating zones into the open atmosphere around the belt. For instance, the interior of the air lock can be placed under vacuum by a suitable pumping arrangement, e.g., an exhaust fan can be used to withdraw air from the air lock. In an arrangement wherein the downstream portion of the steam box is located in the air lock, as the slurry is carried by the belt through the air lock the slurry is only heated by the steam heat transmitted through the belt. Thus, like the slurry on the upstream portion of the steam box located outside the air lock, the slurry heated by the steam beneath the belt is not subjected to any additional heating above the belt until the belt passes into the heating zones.

In the embodiment shown in FIG. 1, the four heating zones 44, 46, 48,50 can be maintained at progressively lower temperatures, e.g., zone 44 can be at 500–625° F., zone 46 can be at 400–500° F., zone 48 can be at 325–400° F. and zone 50 can be at 300–375° F. In an experimental arrangement wherein the drier is 40 feet long and the belt is 60 foot long and 1.5 feet wide, a slurry deposited on the belt at about 150–180° F. (e.g., about 170° F.) and a moisture content of about 60–90% (e.g., about 80%) can be heated by the steam box to about 150–212° F. (e.g., about 180° F.) and then hot air dried in the gas-fired air drier to a moisture content of about 30–50% (e.g., about 35–40%) while moving the belt at speeds of 40 to 60 feet per minute. In a scaled up version suitable for commercial production of reconstituted tobacco sheet wherein the belt is wider (e.g., 4–6 feet wide) and several hundred feet long, it is contemplated that the drier may have over 5 heating zones (e.g., 9 heating zones). However, other types of drying apparatus could be substituted for the air dryer such as electric, steam or gas heated cylindrical driers, electric heating furnaces, or the like.

The reconstituted tobacco sheet can be removed from the end of endless conveyor belt 14 by a doctor blade 60. As indicated above, the slurry can be reduced to a moisture content of approximately 35% to 40% in order to facilitate the doctoring of the dried slurry sheet from off the conveyor belt 14. The partially dried sheet is then passed through a secondary drying arrangement 62 such as a multi-zone gas-fired heating furnace or drum heater to further dry the reconstituted tobacco sheet to a lower moisture content of about 10–20% (e.g., about 15%). However, it should be understood that the slurry may be dried to any desired moisture content and that the secondary drier can be omitted or another treatment substituted therefor.

The steam box can comprise a single enclosure or plurality of adjacent enclosures located along the underside of the belt. While each enclosure can have any desired geometry, according to the embodiment shown in FIGS. 1–3, the steam box 30 is substantially rectangular in shape. In order to withstand the high temperature steam environment, the steam box is preferably made of stainless steel. However, any material or materials suitable for such an environment can also be used for the steam box.

Figure 3:
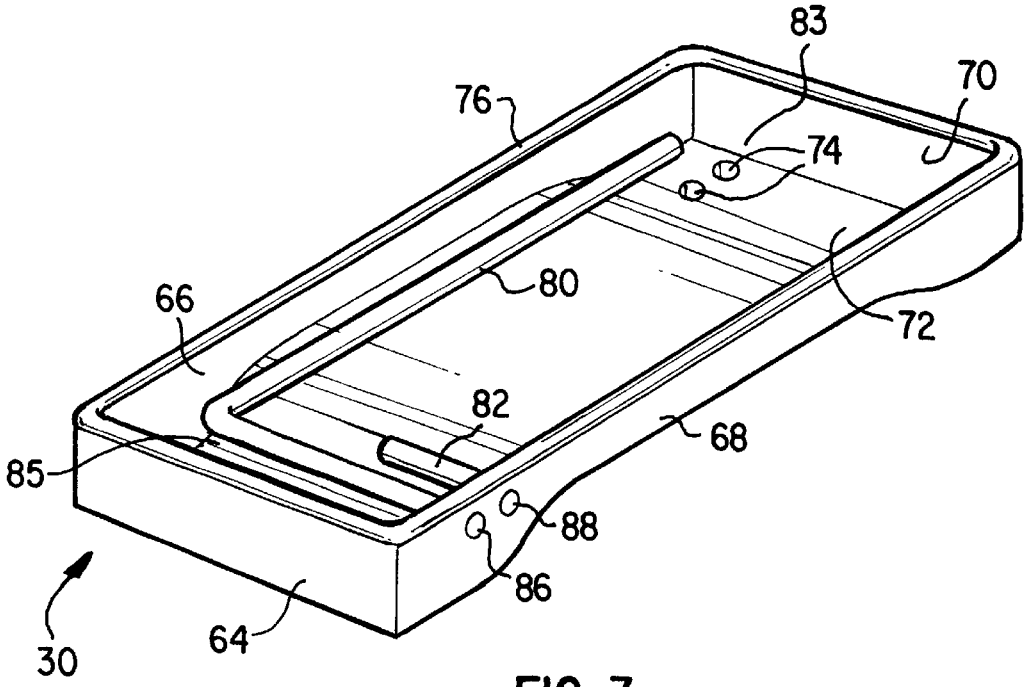
FIG. 3 is a perspective view of a steam box in accordance with the invention wherein details of pipes for supplying steam to the interior of the box and a peripheral edge seal for contacting the underside of the steel conveyor belt are shown.

As shown in FIG. 3, the steam box 30 includes a transverse upstream wall 64, two longitudinally extending side walls 66 and 68, and a transverse downstream wall 70. A bottom wall 72 extends between the lower edges of walls 64,66,68,70. The lower edges of the side walls 66,68 are sloped downwardly towards the end walls 64,70 and the bottom wall 72 conforms to the lower edges of the side walls. As a result, the steam box 30 includes recesses adjacent the end walls 64,70 which collect steam condensate. The condensate can be removed from the steam box by suitable drainage holes such as holes 74. Preferably, at least one condensate drain 74 is located at each recessed portion of the steam box.

The steam box 30 is open at the upper end thereof and a seal 76 is provided around the upper edge to prevent steam from escaping from between the upper edge of the box and the underside of the belt. The seal 76 can comprise a single piece of material or individual sections of material such as a ceramic or resilient material which can withstand a high temperature steam environment and exhibit suitable wear properties due to contact with the moving steel belt. Further, the steam box preferably includes one or more wiping arrangements which remove steam condensate from the underside of the belt. Such wipers can be of the same material as the seal 76. In the embodiment shown in FIG. 2, a wiper 75 extends completely across the steam box at a location adjacent the downstream portion of the box. Depending on the length of the box it may be desirable to provide additional wipers at longitudinally spaced apart locations along the box.

Figure 2:
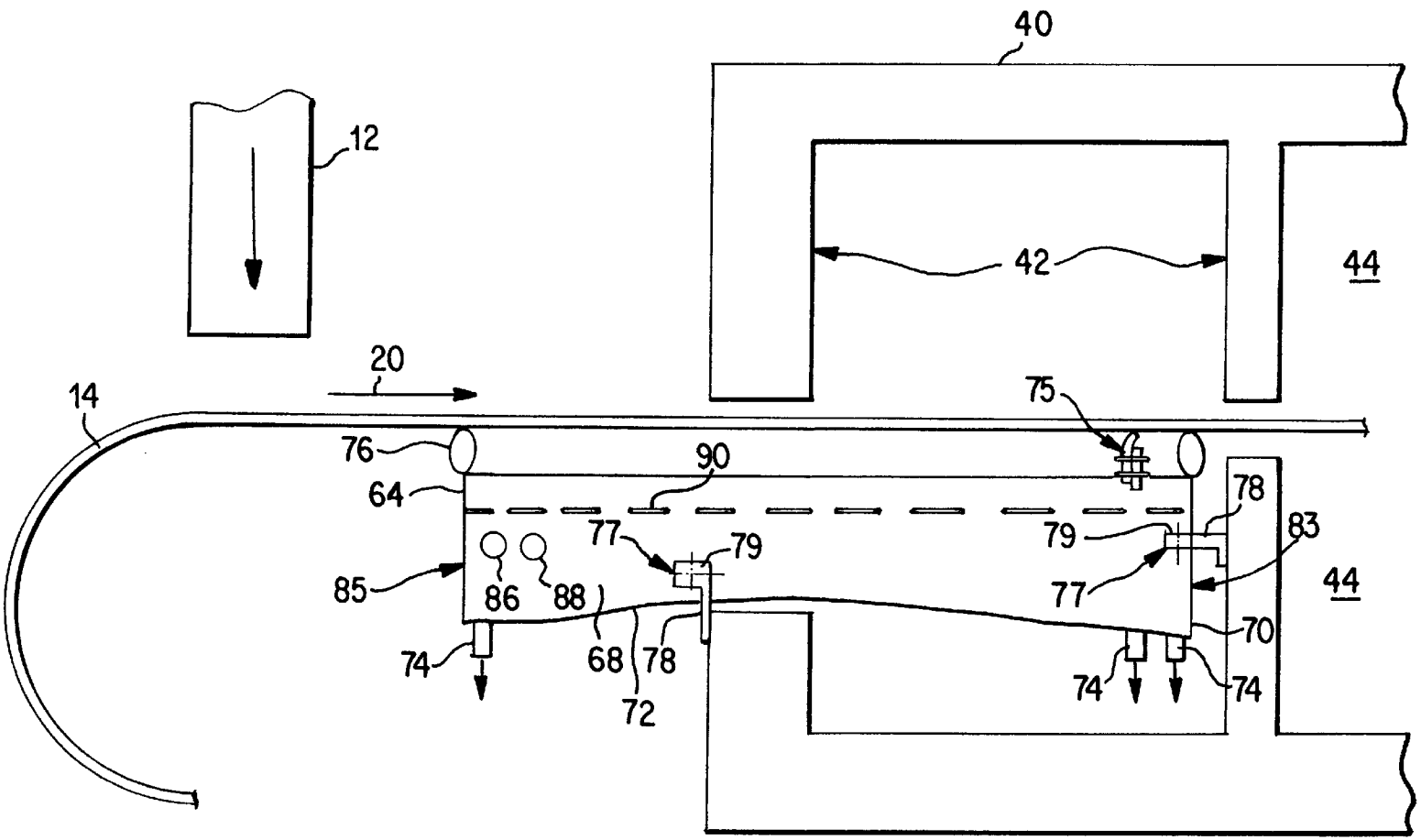
FIG. 2 is an enlarged schematic of the steam box shown in FIG. 1 wherein only a portion of the gas-fired dryer is illustrated.

The seal 76 and wipers 75 can have any desired geometry such as the shape of a bar having an oval cross-section as shown in FIG. 2. A suitable material for the seal and/or wipers is a resilient elastomeric material such as natural or synthetic rubber and a preferred material is a cured ethylene propylene diene monomer (EPDM). Other materials which can be used for the seal and wipers include any high temperature materials such as blends of polymer, ceramic, rubber and/or metal materials. However, it is preferred that the seal and wiper materials permit the conveyor belt 14 to slide over the steam box 30 without undue wear of the belt and/or the seal and wipers, yet provide an adequate sealing arrangement.

A highly advantageous feature of the invention is that the steam box can be attached to an existing processing line in a convenient and inexpensive manner. For instance, in a processing line having an air lock at the entrance to a gas-fired air dryer, the steam box can be mounted in a manner such that the steam box extends into the air lock, as shown in FIG. 1. The steam box 30 can be attached by any suitable technique preferably by securing the steam box directly to the drying apparatus.

As shown in FIG. 2, the steam box 30 can include one or more support brackets, such as brackets 77, welded or otherwise attached to portions of the steam box such as side wall 68. As an example, a pair of brackets can be attached to side wall 68 and another pair of brackets can be attached to side wall 66. Each bracket 77 can include a clip 78 which is welded onto the wall of the drying apparatus 40 and a clip 79 which is welded onto the side wall 68. Holes in the clips 78 and 79 can be aligned and bolted together. However, it should be understood that the steam box 30 may be affixed to the apparatus 10 in other ways which hold the steam box 30 stationary relative to the moving conveyor belt. For instance, the steam box 30 may be affixed to the stationary supports of the conveyor belt 14 or can be supported by a free standing support arrangement. Because the steam box apparatus can be incorporated in existing production lines, it is possible to realize substantial savings in production costs of making reconstituted tobacco sheet with minimal costs associated with manufacture and installation of the steam box.

Steam can be supplied to the steam box 30 by any suitable arrangement. For example, steam can be supplied by a pair of steam tubes 80 and 82 which are conveniently located close together and extend through openings 86 and 88 in side wall 68 near one end of the steam box. In the embodiment shown, steam tube 80 is an L-shaped tube which supplies steam to a first end of the steam box and the other steam tube 82 is a straight tube which supplies steam to the opposite end of the steam box. However, steam can be supplied by other arrangements which achieve a desired distribution of steam in the box. According to a preferred embodiment of the invention, the steam is distributed uniformly in the box to achieve uniform heating of the belt. Nonuniform heating of the belt can result in uneven heating of the slurry with the result that portions of the slurry are dried considerably more than other areas. In extreme cases of nonuniform heating, the belt can become warped which may allow steam to escape into the open atmosphere.

Figure 4:
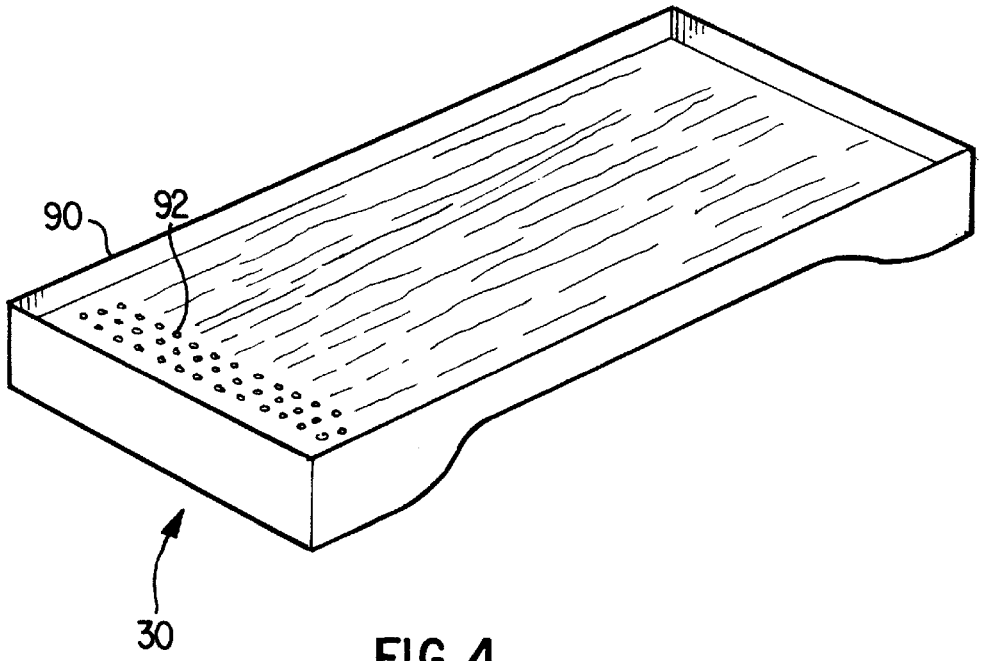
FIG. 4 is a perspective view of a steam box in accordance with the invention wherein a perforated plate is recessed below the upper edge thereof.
Figure 5:
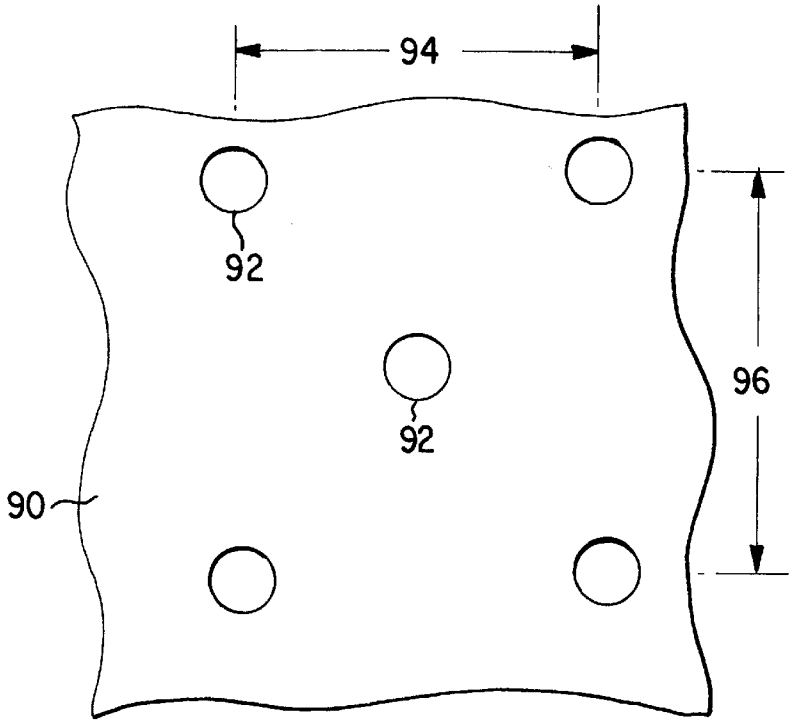
FIG. 5 is a diagram of a hole pattern in the perforated plate shown in FIG. 4.

According to one embodiment of the invention, uniformity of heating of the belt is enhanced by providing a perforated plate 90 between the steam supplied to the box and the underside of the belt. The plate 90 preferably encloses an upper portion of the steam box 30, just below the seal 76, as shown in FIGS. 2 and 4. The perforated plate 90 includes a plurality of openings such as circular holes 92 which are evenly distributed across the plate 90. As illustrated with regard to FIG. 5, the holes can be provided in a pattern having staggered centers such that a horizontal distance 94 between two adjacent holes 92 is smaller than the vertical distance 96 between adjacent holes 92. The holes preferably provide a total open area of about between 5 to 15% or more, preferably about 10 to 12% in the case where steam is supplied to the box at 5 psig. The plate 90 can be 18 gage stainless steel having one-sixteenth inch diameter holes with centers thereof spaced 0.216 inch apart in a transverse direction and 0.250 inch apart in a longitudinal direction.

The temperature rise of the slurry as it travels over the steam box can be predicted according to the formula $\Delta T=0.86(w)(t)$ where $\Delta T$ is the temperature rise of the slurry from the entrance to the exit of the steam box (assuming a slurry thickness of 0.015 to 0.030 inch), w is the steam flow in pounds per hour (pph) per inch width of the steam box (assuming $5 \leqq w \leqq 30$), and t is the residence time (in seconds) of the slurry film over the steam box (assuming t is greater than 2). Thus, the steam box can be designed taking into account the desired temperature rise of the slurry, the length of the steam box and the amount of steam supplied to the steam box. For example, with a given size steam box, the amount of steam supplied to the box can be adjusted by changing the size of the pipes or number of pipes supplying steam to the box. However, the amount and/or pressure of steam supplied to the steam box is preferably below that which lifts the belt away from the seal around the top of the steam box. A useful range for the pressure of steam supplied to the box is 1 to 15 psig, preferably about 5 psig.

Figure 6:
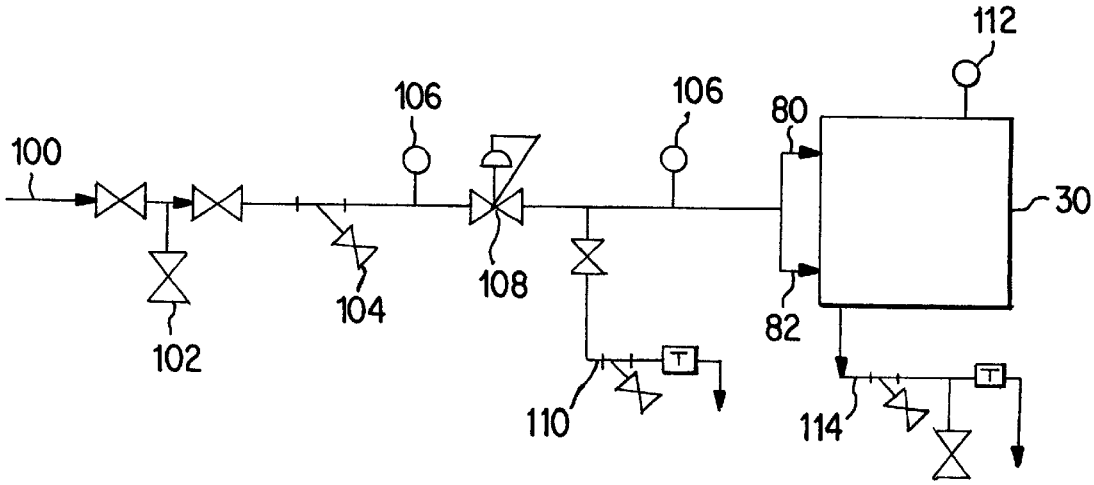
FIG. 6 is a schematic flow diagram of a steam distributing system which can be used to supply steam to the steam box shown in FIG. 1.

FIG. 6 shows one embodiment of a steam supply line for supplying steam to the steam box. Steam is suppled to steam box 30 by way of plant steam which is represented by reference numeral 100. For example, the steam can enter the steam line at 100 psig. In the embodiment shown, the steam travels through the steam line and preferably through a double-block and bleed station 102. The station 102 preferably provides a safe shut off and isolation of the steam box system from the high pressure plant steam during system maintenance.

The steam line can include a strainer 104 for filtering out foreign suspended impurities in the plant steam and one or more two pressure gages 106 such as prior to and after a pressure regulator 108, to indicate local steam pressure at those locations. The pressure regulator 108 functions to decrease the pressure before it enters steam box 30. For example, the pressure regulator 108 can provide pressure reduction of the 100 psig plant steam to the desired range of between 1–10 psig, preferably around 5 psig.

A condensate drain station 110 can be located between the second pressure gage 106 and the pressure regulator 108 to remove condensed water in the steam, and thus provide dry steam to the steam box 30. A temperature gage 112 is preferably disposed at the steam box 30 to indicate the local steam temperature within the steam box 30. Finally, there is preferably another condensate drain station 114 which provides quick removal of steam condensate from the steam box 30.

With reference to FIG. 1, the operation of the apparatus 10 begins with the casting of an aqueous slurry onto the conveyor belt 14. Typically, the slurry has a moisture content between 70–90%, e.g., 78.5%. The cast slurry is conveyed in the direction of arrow 20 and is moved across the steam box 30. The steam box 30 is provided with steam from the steam plant (not shown) and functions to heat the underside of the conveyor belt 14, which transfers heat to the slurry. Preferably, steam is introduced into the steam box 30 at a rate of approximately 5 psig. The temperature of the slurry is raised to about between 170° F. to about 190° F., and preferably around 185° F., where drying initiates in tobacco slurries without causing degradation of the tobacco product.

The pre-treated slurry is then conveyed through the drying apparatus 40, thereby further reducing the moisture content, so that the dried slurry may be doctored off by the doctor blade 60. The slurry is then conveyed to a secondary drying arrangement 62 which further reduces the amount of water in the slurry. Once the slurry is dried into a sheet, it may be cut to a desired size and used in place of natural tobacco leaves.

While the invention has been particularly shown and described with reference to preferred embodiments, it would be understood by those skilled in the art that various changes in form and details may be made without departing from the spirit and scope of the invention. For instance, the steam box could be located beneath the slurry caster and extend up to the air dryer. Such an arrangement would reduce or eliminate any drop in temperature of the slurry as it is deposited on the conveyor belt and is transported into the hot air dryer. As in the earlier embodiments, the steam box would minimize temperature gradients across the thickness and/or width of the slurry due to the intense steam heating on the underside of the belt. In the conventional hot air drier without the steam box, temperature gradients in the slurry could cause layer formation and/or film splitting since the slurry would drop in temperature when deposited on the belt and then the center of the slurry would be cooler than the upper and lower surfaces of the slurry during heating in the air drier.

What is claimed is:

1. A method of producing a sheet of reconstituted tobacco from an aqueous slurry, comprising the steps of:

depositing an aqueous tobacco slurry on a moving conveyor;

and drying the slurry in an air dryer to dry the slurry into a sheet form;

said method further comprising the step of controlling film formation on the slurry during said drying step by heating an underside of said conveyor with steam at a location adjacent an entrance of said air dryer and said drying step being performed downstream of said film formation controlling step without heating the underside of the conveyor with steam.

2. The method of claim 1, wherein an exposed surface of the slurry is heated with hot air during the drying step.

3. The method of claim 1, wherein the steam heats the conveyor such that the slurry is heated to about 170° F. to 190° F.

4. The method of claim 1, further comprising a step of doctoring the sheet from the conveyor.

5. The method of claim 4, further comprising a step of secondary drying the sheet after the sheet is removed from the conveyor.

6. The method of claim 1, wherein the conveyor comprises a stainless steel belt and the steam is supplied to a steam box having a perforated plate, the steam passing through the perforated plate prior to contacting an underside of the belt, the perforated plate having openings which distribute the steam uniformly beneath the belt and effect uniform heating of the slurry.

7. The method of claim 1, wherein a lower surface of the slurry in contact with the conveyor is heated by the steam for at least two seconds while an opposed upper surface of the slurry is exposed to air at ambient temperature.

8. The method of claim 1, wherein the heating step is carried out with a steam box supplied with steam at 1 to 15 psig, the drying step lowers moisture in the slurry to about 20 to 40%, and the method further includes a step of secondary drying the sheet which lowers the moisture content of the sheet to below about 20%.

9. The method of claim 1, wherein a portion of the conveyor above an upstream portion of the steam heating is exposed to air.

10. The method of claim 9, wherein a portion of the conveyor above a downstream portion of the steam heating is located in an air lock zone.

11. The method of claim 2, wherein the hot air is produced in heating zones, the zones heating the sheet to progressively lower temperatures as the sheet travels through the zones.

12. The method of claim 2, wherein steam is contained in a steam box and the air dryer includes an air lock, the steam box being arranged such that the steam heats the slurry immediately upstream of the air lock and while the slurry travels through the air lock.

13. In a method for manufacturing reconstituted tobacco sheet having a predetermined moisture content wherein a tobacco slurry is deposited on a moving conveyor and moisture is removed from the slurry in an air drier as the slurry is carried by the conveyor in a downstream direction, the improvement comprising increasing throughput of the drier by increasing speed of the conveyor by at least 10% and using a preheater which steam heats an underside of the conveyor immediately upstream of the drier.

14. The method according to claim 13, wherein the steam heating results in driving moisture from the inside to the outside of the slurry.

15. The method according to claim 13, wherein the speed of the conveyor is increased at least 25%.

16. The method according to claim 13, wherein the drier comprises a series of drying zones in which hot air is passed below and above the conveyor.

17. The method according to claim 13, wherein the steam heating heats a lower surface of the slurry while an opposed upper surface of the slurry is exposed to ambient air.

18. The method according to claim 13, wherein the slurry is doctored from the conveyor and then passed through a secondary heater in which the moisture content of the slurry is lowered to 10 to 20%.

19. The method according to claim 13, wherein the preheater comprises a steam box attached to an existing processing line of a reconstituted tobacco sheet manufacturing apparatus.

20. The method according to claim 13, wherein the preheater comprises a steam box having a length in the downstream direction such that $\Delta T=0.86(w)(t)$ where $\Delta T$ is the temperature rise of the slurry from the entrance to the exit of the steam box, w is the steam flow into the box in pounds per hour per inch width of the steam box, and t is the residence time of the slurry over the box in seconds.

21. The method according to claim 20, wherein the slurry travels over the steam box for at least 2 seconds.

* * * * *